US006572409B2

(12) United States Patent
Nitta et al.

(10) Patent No.: US 6,572,409 B2
(45) Date of Patent: Jun. 3, 2003

(54) CONNECTOR HAVING A GROUND MEMBER OBLIQUELY EXTENDING WITH RESPECT TO AN ARRANGEMENT DIRECTION OF A NUMBER OF CONTACTS

(75) Inventors: Kunihiro Nitta, Inagi (JP); Shuuhei Fujita, Yokohama (JP); Hidenao Nakajima, Yokohama (JP)

(73) Assignee: Japan Aviation Electronics Industry, Limited, Shibuyu-Ku (JP)

( * ) Notice: Subject to any disclaimer, the term of this patent is extended or adjusted under 35 U.S.C. 154(b) by 0 days.

(21) Appl. No.: 10/027,151

(22) Filed: Dec. 20, 2001

(65) Prior Publication Data

US 2002/0086582 A1 Jul. 4, 2002

(30) Foreign Application Priority Data

Dec. 28, 2000 (JP) ..... 2000-400332

(51) Int. Cl.[7] ..... H01R 13/648

(52) U.S. Cl. ..... 439/608; 439/660

(58) Field of Search ..... 439/608, 101, 439/108, 607, 609

(56) References Cited

U.S. PATENT DOCUMENTS 6,146,202 A * 11/2000 Ramey et al. ..... 439/608
6,179,663 B1 * 1/2001 Bradley et al. ..... 439/608
6,227,882 B1 * 5/2001 Ortega et al. ..... 439/101

* cited by examiner

*Primary Examiner*—P. Austin Bradley
*Assistant Examiner*—Alexander Gilman
(74) *Attorney, Agent, or Firm*—Michael Best & Friedrich LLC

(57) ABSTRACT

A connector element has a plurality of contacts (23) arranged in first and second directions (A1, A2) perpendicular to each other on a predetermined plane to form a matrix. A plurality of ground members (25) extend substantially in parallel to one another in an oblique direction inclined with respect to the first and the second direction on the predetermined plane. At least one of the contacts is positioned between adjacent ones of the ground members.

14 Claims, 6 Drawing Sheets

CONNECTOR HAVING A GROUND MEMBER OBLIQUELY EXTENDING WITH RESPECT TO AN ARRANGEMENT DIRECTION OF A NUMBER OF CONTACTS

BACKGROUND OF THE INVENTION

The present invention relates to a connector adapted to connect a signal line for transmitting a signal at a high speed.

A connector apparatus of a vertical-connection type is for use in connecting a back board and a package board arranged to be perpendicular to the back board. The connector apparatus comprises a back board side connector mounted on the back board and a package board side connector mounted on the package board to be connected to and disconnected from the back board side connector.

The back board side connector comprises a number of contacts arranged in arrays in first and second directions perpendicular to each other on the back board to form a matrix. As the contacts of the back board side connector, use is generally made of pin contacts of a straight type. In order to cope with high-speed transmission, a ground plate is interposed at least partially between adjacent contact arrays. The ground plate extends in the first or the second direction.

In the high-speed transmission, use is sometimes made of a differential transmission technique in which a signal is transmitted through a pair of transmission lines as a single signal path. In this case, the ground plate is fixedly arranged to extend in one of the first and the second directions so as to optimize transmission characteristics in the single signal path. On the other hand, a pair of contacts inserted and connected to the pair of transmission lines may be arranged in the first direction or the second direction. Therefore, the contact pair may possibly be unadapted to the arrangement of the ground plate. In this event, the transmission characteristics will be degraded.

It is assumed here that two back board side connectors same in structure are mounted on front and back surfaces of the back board at positions shifted by 90° from each other and that pin contacts penetrating the back board are used in common by the two back board side connectors. In this case, the pin contacts can be paired in parallel to the ground plate in one connector on the front side of the back board. However, in the other connector on the other side of the back board, the same pin contacts are paired to be perpendicular to the ground plate with the ground plate interposed therebetween. This deteriorates the transmission characteristics. The above-mentioned problem can be avoided if connectors different in structure are used on the front and the back sides of the back board. However, such use of the connectors different in structure is uneconomical.

When the contacts are paired in a direction which is not accords with that of the package board side connector, a pair of the transmission lines are different in length from each other so that a so-called skew, i.e., a difference in propagation delay, is produced in the transmission line pair.

SUMMARY OF THE INVENTION

It is therefore an object of this invention to provide a connector element which contributes to improvement in transmission characteristic of a high-speed signal transmission line.

It is another object of this invention to provide a connector of a relay type excellent in transmission characteristic and superior in economical efficiency.

It is still another object of this invention to provide a connection apparatus using the above-mentioned connector.

Other objects of the present invention will become clear as the description proceeds.

According to an aspect of the present invention, there is provided a connector element which comprises a plurality of contacts arranged in first and second directions perpendicular to each other on a predetermined plane to form a matrix, and a plurality of ground members extending substantially in parallel to one another in an oblique direction inclined with respect to the first and the second direction on the predetermined plane. At least one of the contacts is positioned between adjacent ones of the ground members.

According to another aspect of the present invention, there is provided a connector which comprises two of the above-mentioned connector element. The connector elements are arranged adjacent to each other in a third direction perpendicular to the predetermined plane. The ground members in one of the connector elements are arranged in parallel to those in the other connector element.

According to still another aspect of the present invention, there is provided a connector to be connected to the first-mentioned connector. The connector comprises a housing and a plurality of contacts having contact contacting portions arranged within the housing in the first and the second directions to form a matrix. The housing has a plurality of slots extending in the oblique direction between adjacent ones of the contacting portions. The contact contacting portions are brought into contact with the contacts of the connector element with the ground members of the connector element received in the slots when the connector is connected to the connector element.

According to yet another aspect of the present invention, there is provided a connector apparatus which comprises a package board side connector mounted on a package board, and a back board side connector mounted on a back board to be connected to the package board side connector. The back board side connector comprises a plurality of conductive back board side contacts arranged in a matrix, a plurality of back board side ground plates, and an insulating housing holding the back board side contacts and the back board side ground plates. The back board side ground plates includes first and second back board side ground plates. At least one of the first and the second back board side ground plates is provided with a contacting portion connected to the other. The first back board side ground plate is arranged obliquely across contact-to-contact spaces defined between every two adjacent ones of the back board side contacts adjacent in a column or a row direction from one contact-to-contact space to another contact-to-contact space next adjacent to the one contact-to-contact space both in the column direction and the row direction. The second back board side ground plate is arranged between two adjacent ones of the back board side contacts and in a direction intersecting the first back board side ground plate.

DESCRIPTION OF THE PREFERRED EMBODIMENTS

Figure 1:
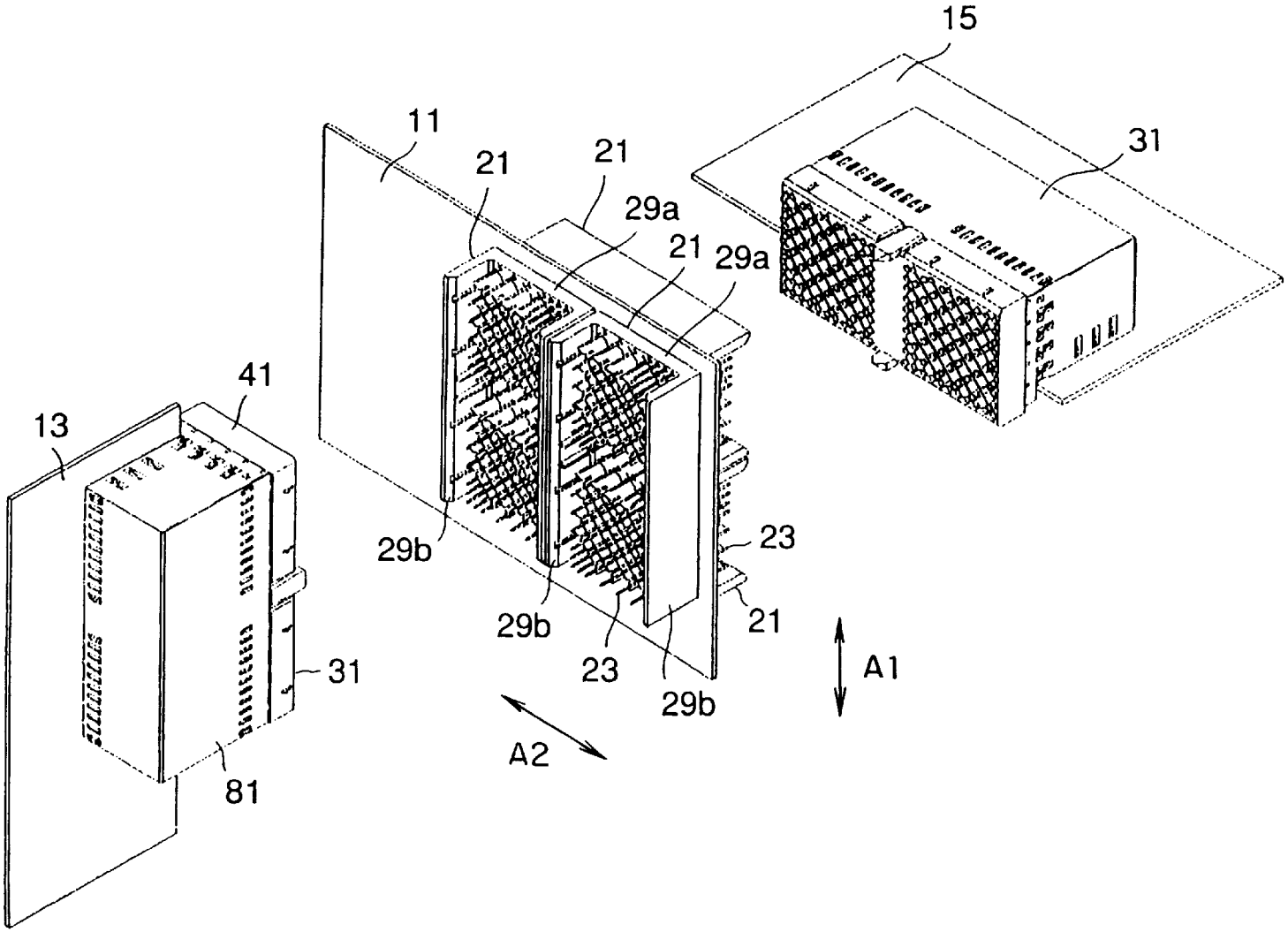
FIG. 1 is a perspective view of a whole of a connecting apparatus according to one embodiment of this invention in a disconnected state.

Now, description will be made of a connector apparatus according to an embodiment of this invention with reference to the drawing.

Referring to FIG. 1, a back board 11 extends in a predetermined vertical plane. On front and back sides of the back board 11, package boards 13 and 15 are arranged, respectively. Each of the package boards 13 and 15 are arranged to be perpendicular to the back board 11. The package board 13 on the front side of the back board 11 extends in a vertical direction as a first direction A1. The package board 15 on the back side of the back board 11 extends in a horizontal direction as a second direction A2. Each of the back board 11 and the package boards 13 and 15 is provided with an electrical circuit (not shown).

The back board 11 has front and back surfaces with a plurality of back board side connectors 21 are mounted thereon. In FIG. 1, a set of two back board side connectors 21 are mounted on the front surface of the back board 1. Similarly, another set of two back board side connectors 21 are mounted on the back surface of the back board 11 but shifted in position by 90° from those on the front surface.

On each of the package boards 13 and 15, a package board side connector 31 is mounted. As will later be described in detail, the package board side connector 31 is adapted to be connected to and disconnected from the back board side connector 21.

The back board side connectors 21 are provided with a number of conductive back board side contacts 23. Each of the back board side contacts 23 is of a straight pin type. The back board side contacts 23 are arranged in the first and the second directions A1 and A2 to form a matrix. Via through holes (not shown) penetrating the back board 11 in a thickness direction, the back board side contacts 23 protrude on the front and the back surfaces of the back board 11 to be perpendicular thereto. The back board side contacts 23 are adapted to be connected to a plurality of conductive package board side contacts (not shown in FIG. 1) of the package board side connectors 13 and 15.

Figure 2:
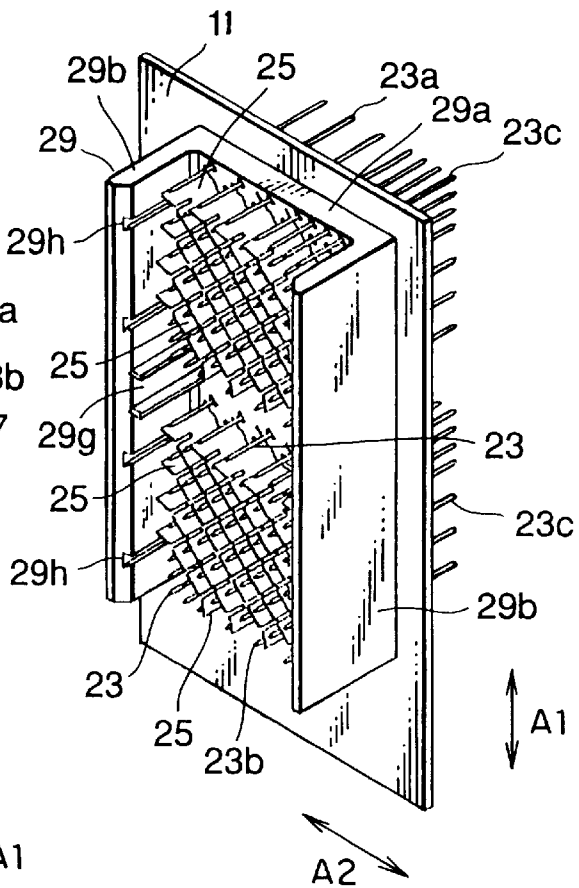
FIG. 2 is an enlarged perspective view of a part of a back board side connector in the connector apparatus illustrated in FIG. 1.
Figure 3:
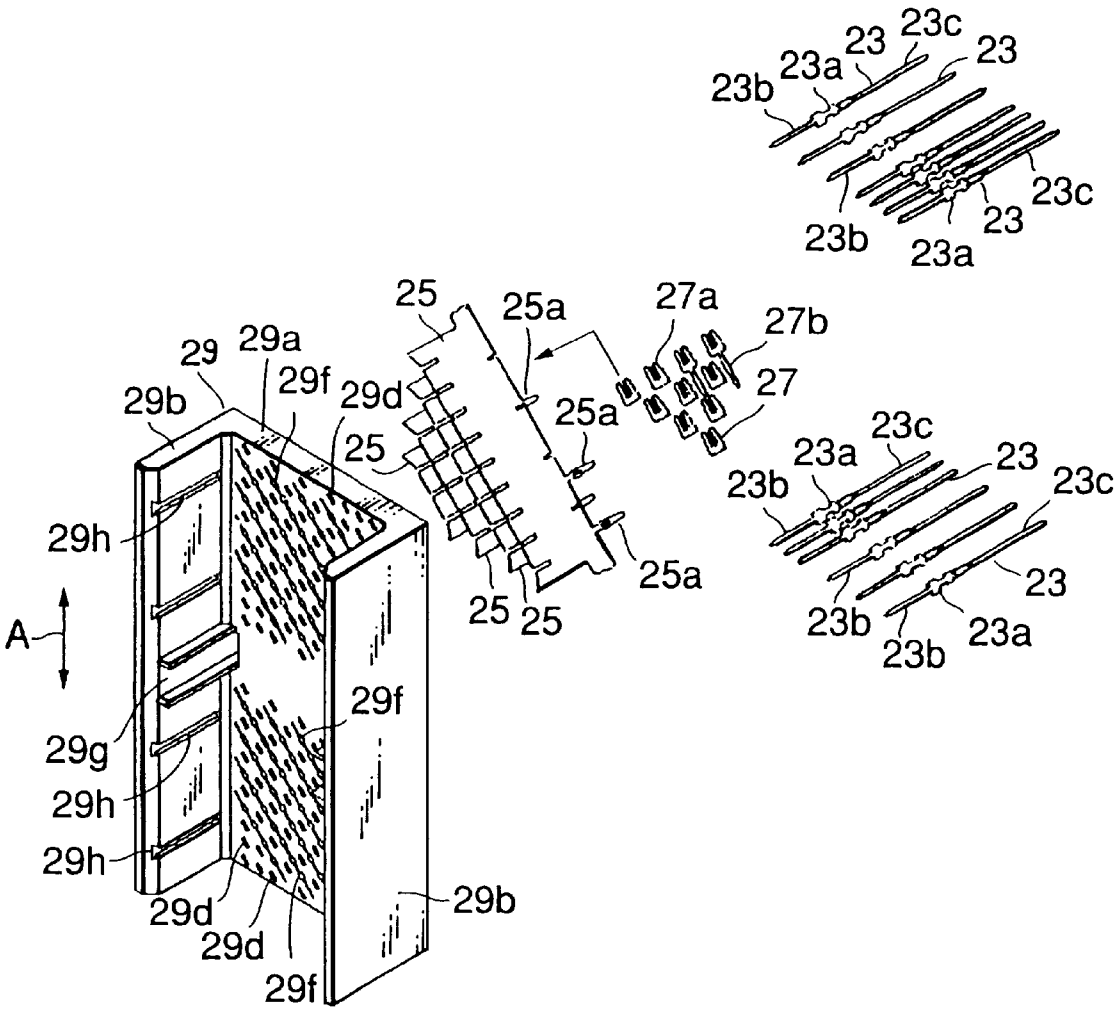
FIG. 3 is an exploded perspective view of the back board side connector illustrated in FIG. 2 but some parts omitted therefrom.

As illustrated in FIGS. 2 and 3 also, each of the back board side connectors 21 further comprises a plurality of first back board side ground plates 25, a plurality of second back board side ground plates 27, and an insulating housing 29 holding the back board side contacts 23 and the first and the second back board side ground plates 25 and 27. Each of the second back board side ground plates 27 is provided with a contacting portion 27*a* to be connected to the first back board side ground plate 25. A part equivalent to the contacting portion 27*a* may be formed on either one of the first and the second back board side ground plates 25 and 27.

The housing 29 comprises a rectangular base plate 29*a* faced to the back board 11 and extending in parallel thereto and a pair of frame plates 29*b* extending from opposite longitudinal edges of the base plate 29*a* to be perpendicular to the base plate 29*a* and to be faced to each other. The base plate 29*a* has a plurality of contact holding holes 29*d*. The contact holding holes 29*d* are formed at positions corresponding to the through holes penetrating the back board 11 in the thickness direction to insert the back board side contacts 23. Thus, the contact holding holes 29*d* are arranged in the first and the second directions A1 and A2 to form a matrix.

Each of the back board side contacts 23 has a holding portion 23*a* formed at an intermediate portion thereof to be press-fitted to and held by the contact holding hole 29*d*. Furthermore, the back board side contact 23 has back board side contacting portions 23*b* and 23*c* extending from opposite ends of the holding portion 23*a* in directions opposite to each other. When the back board side connector 21 is mounted on the back board 11, the back board side contacting portions 23*b* and 23*c* protrude on the front and the back surfaces of the back board 11, respectively, to be perpendicular to the back board 11. Each of the back board side contacting portions 23*b* and 23*c* is a portion to be brought into contact with a package board side contact of the package board side connector as will later be described.

Each of the first back board side ground plates 25 is made of metal and extends substantially in parallel to one another in an oblique direction inclined with respect to the first and the second directions A1 and A2 on the predetermined plane. Specifically, the first back board side ground plate 25 is arranged obliquely across contact-to-contact spaces defined between every two adjacent ones of the back board side contacts 23 adjacent in the first direction A1 (or the second direction A2) from one contact-to-contact space to another contact-to-contact space next adjacent to the one contact-to-contact space both in the first and the second directions A1 and A2. The first back board side ground plates 25 have a shape of a tie plate and are different in length from one another because they are obliquely arranged on the base plate 29*a*. Each of the first back board side ground plates 25 has a plurality of first ground connecting portions 25*a* formed at one longitudinal side to protrude in a widthwise direction. The first ground connecting portions 25*a* are respectively inserted into a plurality of first insertion holes 29*f* formed on the base plate 29*a* of the housing 29 and then into a plurality of connecting through holes formed on the back board 11 to be connected to the electrical circuit formed on the back board 11.

Each of the second back board side ground plates 27 is made of metal. The second back board side ground plates 27 are arranged in a direction intersecting the first back board side ground plates 25 and between every two adjacent ones of the back board side contacts 23. The contacting portion 27*a* of the second back board side ground plate 27 has a socket-like shape or a slit to clamp the first back board side ground plate 25. The second back board side ground plate 27 is assembled such that the slit is fitted over the edge portion of the first back board side ground plate 25. The second back board side ground plate 27 is connected to the electrical circuit of the back board 11 through the first back board side ground plates 25. The second back board side ground plate 27 may be provided with a second ground connecting portion 27*b* to be connected to the electrical circuit of the back board 11.

On the front and the back surfaces of the back board 11, the back board side connectors 21 are mounted so that the first and the second back board side ground plates 25 and 27 are similarly oriented on both of the front and the back surfaces of the back board 11. The back board side contacts 23 protrude on the front and the back surfaces of the back board 11 to be used in common by the back board side connectors 21 on the front and the back surfaces of the back board 11.

Figure 4:
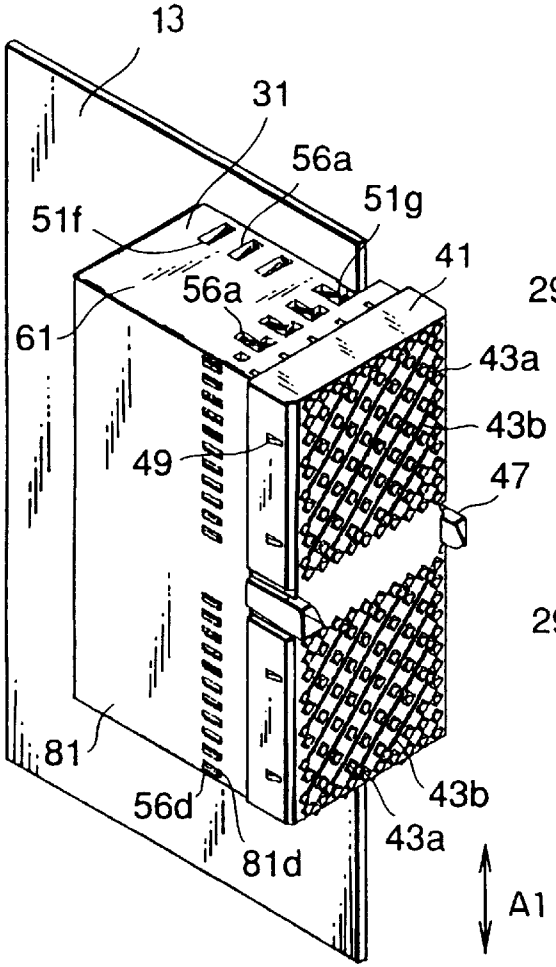
FIG. 4 is an exploded perspective view of a package board side connector in the connector apparatus illustrated in FIG. 1 as seen in a different direction.
Figure 5:
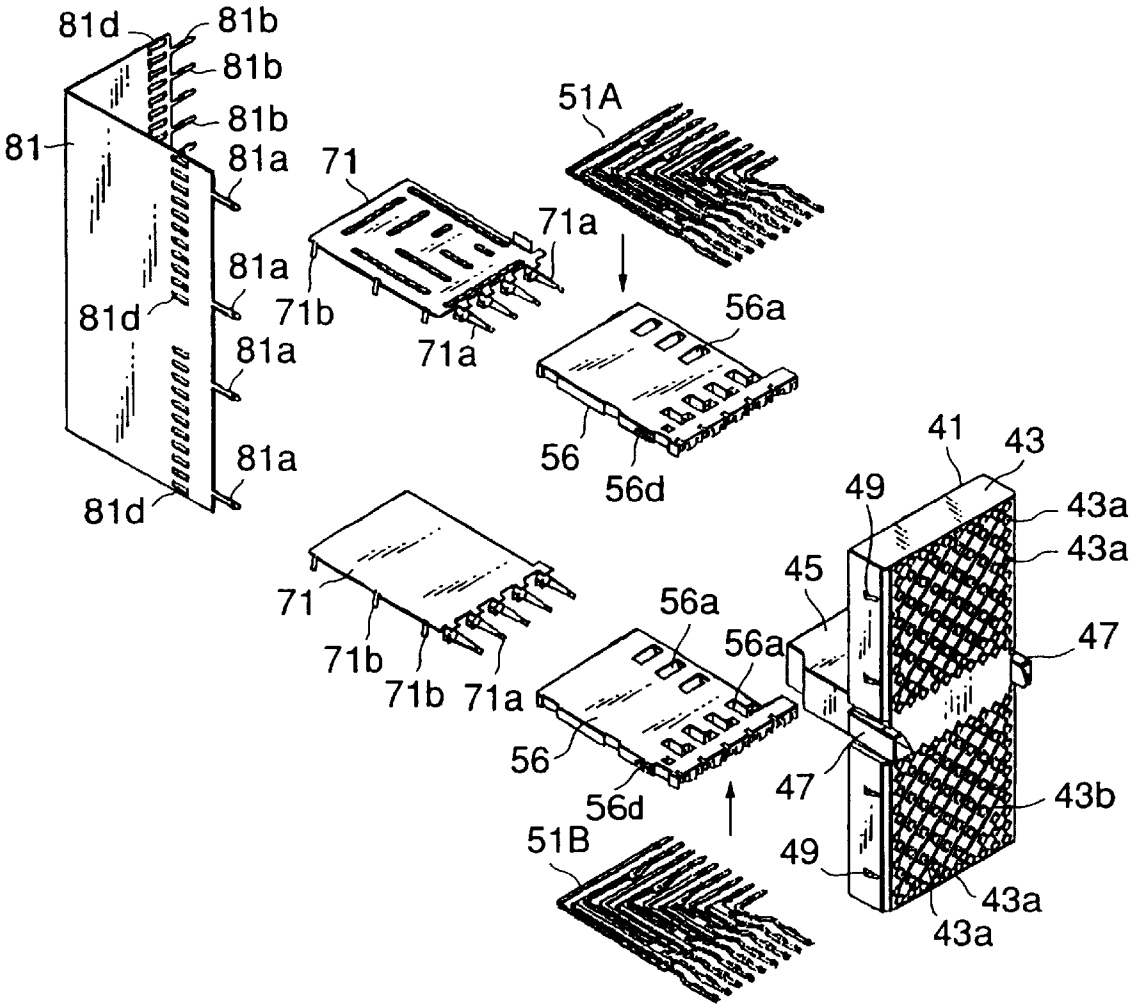
FIG. 5 is an exploded perspective view of the package board side connector illustrated in FIG. 4 but some parts omitted therefrom.

Referring to FIGS. 4 and 5, description will be made of the package board side connector 31.

The package board side connector 31 comprises a single front housing 41 made of an insulating material, a plurality of package board side contacts 51A and 51B, a plurality of insulators 56, a plurality of package board side ground plates 71, and a single shield plate 81.

The front housing 41 comprises a front housing body 43 having a rectangular shape so as to be inserted between the frame plates 29*a* of the back board side connector 21, a partitioning plate 45 formed on a back surface of the front housing body 43 and extending from a longitudinal center portion thereof to be perpendicular to the front housing body 43, a pair of guide portions 47 extending from a pair of longitudinal parallel side surfaces of the front housing body 43 and protruding above a front surface of the front housing body 43, and a plurality of protrusions 49 protruding on the side surfaces.

The front housing body 43 is provided with a plurality of contact insertion holes 43*a* for inserting the back board side contacts 23 and a plurality of slots 43*b* for inserting the first back board side ground plates 25. The contact insertion holes 43*a* are formed at positions corresponding to the back board side contacts 23. Specifically, the contact insertion holes 43*a* are arranged in the first and the second directions A1 and A2 to form a matrix. The slots 43*b* correspond to the first back board side ground plates 25 and extend in the oblique direction intersecting the first and the second directions A1 and A2.

The guide portions 47 are fitted into a pair of guide frame portions 29*g* formed on opposite inner surfaces of the frame plates 29*b*, respectively. The protrusions 49 are fitted into a plurality of guide grooves 29*h* formed on the opposite inner surfaces of the frame plates 29*b*, respectively.

Each of the package board side ground plates 71 is made of metal and has a generally rectangular shape. The package board side ground plate 71 has a plurality of package board side ground contacting portions 71*a* extending from one side perpendicular to its longitudinal direction. The package board side ground plate 71 is provided with a plurality of shield contacting portions 71*b* formed on one side parallel to the longitudinal direction to be perpendicular to the package board side ground plate 71.

The shield plate 81 is a metal plate having an L shape in a side view and surrounds the insulators 56 and the ground plates 71 in cooperation with the front housing 41. The shield plate 81 has a plurality of shield side contacting portions 81*a* and 81*b* extending from opposite sides thereof, respectively. The shield side contacting portions 81*a* on one side are brought into contact with one or more of the first back board side ground plates 25 together with the shield contacting portions 71*b* of the package board side ground plates 71. The shield side contacting portions 81*b* on the other side are brought into contact with a shield circuit of the package board 13 or 15.

Furthermore, the shield plate 81 has a plurality of rectangular holes 81*d*. The holes 81*d* are engaged with a plurality of engaging protrusions 56*d* formed on side surfaces of the insulators 56.

When the package board side connector 31 is fitted to the back board side connector 21, the holding portions 23*a* of the package board side contacts 23 are inserted into the contact insertion holes 29*d* and the first back board side ground plates 25 are inserted into the slots 43*b*. In this state, the package board side contacts 51A and 51B are brought into contact with the back board side contacts 23. At least one of the package board side contacts 51A and 51B is brought into contact with one or more of the first back board side ground plates 25. As a consequence, while the package board side connectors 13 and 15 are connected to the back board side connectors 21, signal contacts 53 (will later be described) are shielded by the first back board side ground plates 25.

As the package board side contacts 51A and 51B, use may be made of right-angle contacts. In this case, the package board side connector 31 is a right-angle socket connector.

Figure 6:
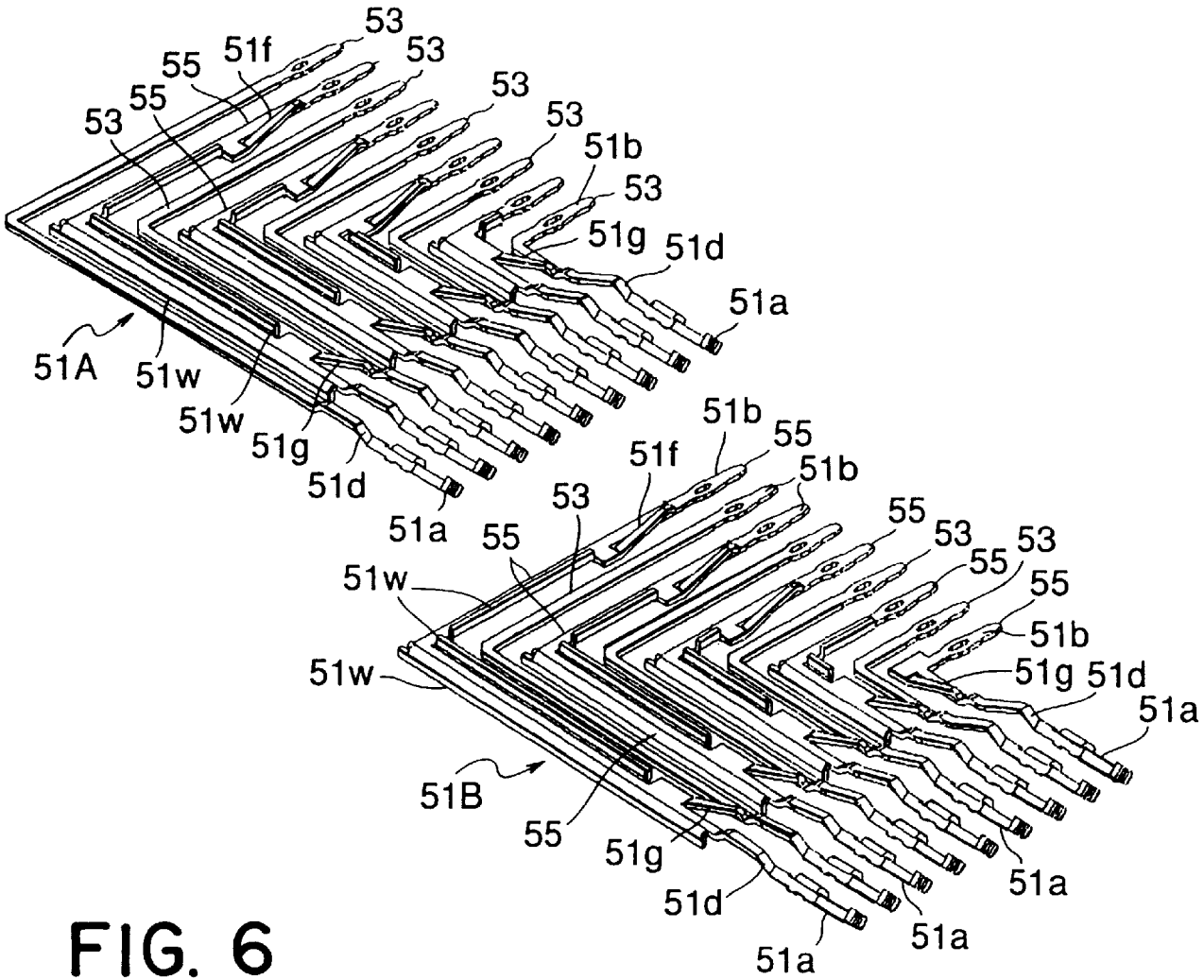
FIG. 6 is a perspective view of package board side contacts illustrated in FIG. 4.

Referring to FIG. 6 in addition, description will be made of the package board side contacts 51A and 51B. Each of the package board side contacts 51A and 51B comprises a plurality of the signal contacts 53 and a plurality of ground contacts 55. The signal contacts 53 and the ground contacts 55 are perpendicularly bent at their intermediate portions and are arranged adjacent to one another on a virtual plane without contacting one another. In the package board side contacts depicted by reference numerals 51A, each of the ground contacts 55 is placed between adjacent ones of the signal contacts 53. In the package board side contacts depicted by reference numerals 51B, each of the signal contacts 53 is placed between adjacent ones of the ground contacts 53.

Each of the signal contacts 53 and the ground contacts 55 has a package board side contacting portion 51*a* formed at its one end. The package board side contacting portions 51*a* are located in the contact insertion holes 43*a* of the front housing 43 to be brought into contact with the back board side contacts 23. Each of the signal contacts 53 and the ground contacts 55 is provided with a package board side connecting portion 51*b* to be connected to the electrical circuit on the package board 13 or 15.

The package board side contacting portion 51*a* is provided with a twisted portion 51*d* formed at its base by twisting a material plate at a part of the intermediate portion between the contacting portion 51*a* and the connecting portion 51*b* of the contact 55. The ground contact 55 has ground plate contacting portions 51*f* and 51*g* formed behind the package board side connecting portion 51*b* and the twisted portion 51*d*, respectively, and extending in a cantilevered fashion above the virtual plane to be brought into contact with the ground plate 71, and a widened portion 51*w* formed at its intermediate portion and bent to stand up above the virtual plane.

The ground plate contacting portions 51*f* and 51*g* are formed at both end portions of the widened portion 51*w*. The widened portion 51*w* extends from the twisted portion 51*d*.

Figure 7:
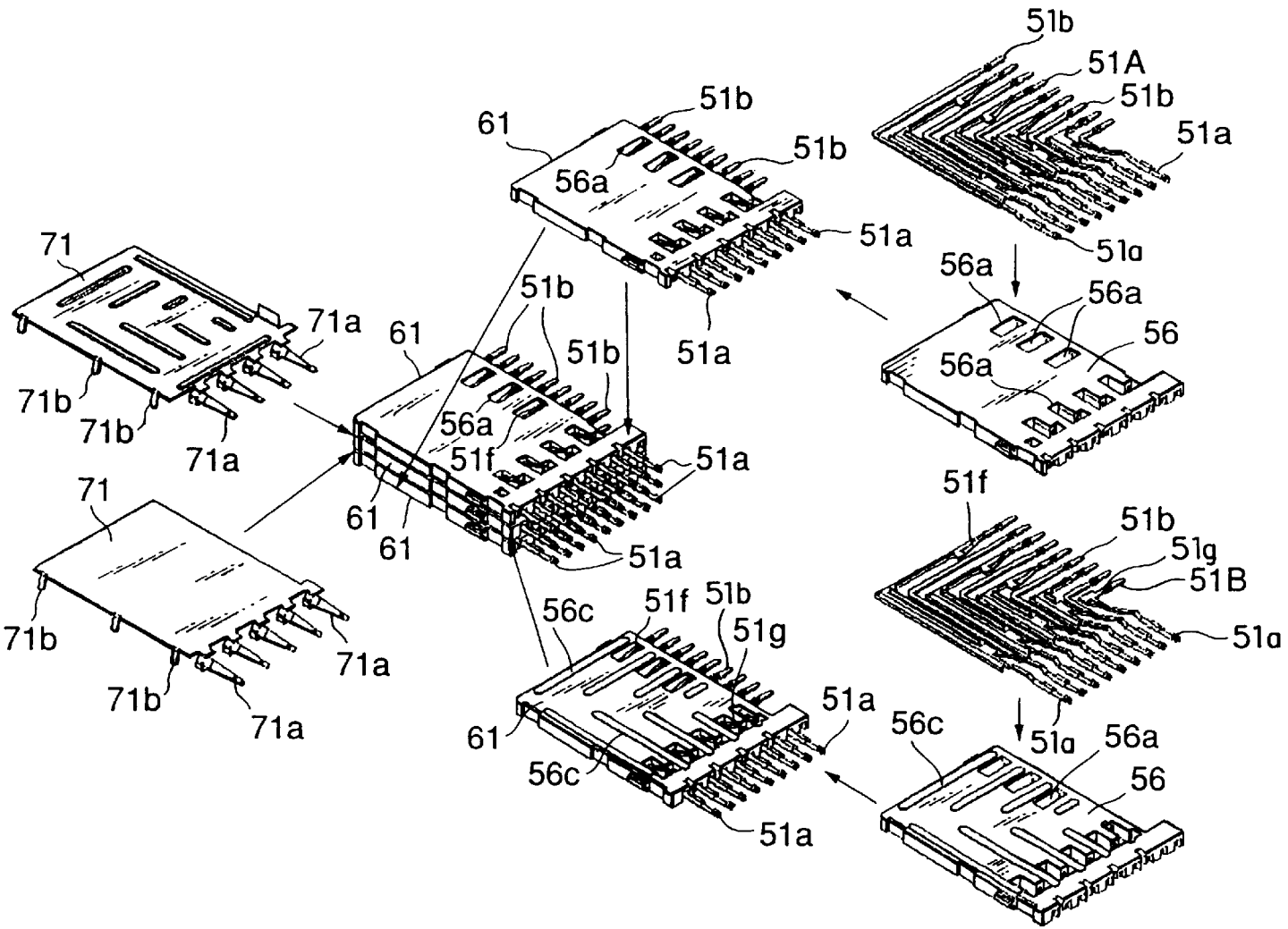
FIG. 7 is a perspective view for describing assembling of the package board side connector illustrated in FIG. 4.

Referring to FIG. 7 in addition to FIGS. 4 through 6, the package board side contacts 51A and 51B will further be described.

Each of the insulators 56 has a generally rectangular shape. The package board side contacts 51A or 51B are coupled to one surface of each of the insulators 56 to form a contact module 61. Alternatively, the package board side contacts 51A or 51B may be integrally formed with each of the insulators 56 when each insulator is molded.

The package board side contacting portions 51*a* extend from one side surface perpendicular to the longitudinal direction. The package board side connecting portions 51*b* extend from another side surface parallel to the longitudinal direction. Each of the insulators 56 is provided with a plurality of window portions 56*a* where the ground plate contacting portions 51*f* and 51*g* are exposed. Selected ones of the insulators 56 are provided with a plurality of ribs 56*c* receiving the widened portions 51*w*, respectively.

The contact modules 61 and the package board side ground plates 71 are alternately stacked to sandwich each other. In this state, the contact modules 61 and the package board side ground plates 71 are integrally coupled by the front housing 41. As a consequence, the ground plate contacting portions 51*f* and 51*g* of the ground contact 55 are brought into contact with the package board side ground plate 71 through the window portions 56*a*.

In the connector apparatus described above, a pair of transmission lines same in ground structure are formed by the use of the same connectors on both of the front and the back surfaces of the back board 11. Therefore, it is possible to prevent deterioration in transmission characteristic on the front or the back surface. In addition, the connector apparatus is economical because the connectors different in structure need not be used on the front and the back surfaces of the back board 11. The difference in length of the transmission lines in each pair is reversed between one and the other package board side connectors on the front and the back sides of the back board 11. Therefore, the transmission lines in each pair are equal in total length through the back board side connectors 21 and the package board side connectors 13 and 15. Therefore, a skew or a difference in propagation delay is avoided within the connector apparatus.

What is claimed is:

1. A connector element comprising:

a plurality of contacts arranged in first and second directions perpendicular to each other on a predetermined plane to form a matrix;

a plurality of ground members extending substantially in parallel to one another in an oblique direction inclined with respect to said first and said second direction on said predetermined plane, at least one of said contacts being positioned between adjacent ones of said ground members;

a housing;

a plurality of contacts having contact contacting portions arranged within said housing in said first and said second directions to form a matrix, said housing having a plurality of slots extending in said oblique direction between adjacent ones of said contacting portions, said contact contacting portions being brought into contact with the contacts of said connector element with said ground members of said connector element received in said slots when said connector is connected to said connector element;

a plurality of insulators holding said contacts divided into a plurality of groups in said first direction; and a plurality of ground plates attached to said insulators in said first direction, respectively, said housing integrally coupling said insulators and said ground plates, each of said insulators having a window portion faced to said ground plate, a specific contact in each group having a ground plate contacting portion brought into contact with said ground plate through said window portion, said ground plate being brought into contact with said ground member when said connector is connected to said connector element.

2. The connector element according to claim 1, further comprising a housing which serves to fix a positional relationship between said contacts and said ground members.

3. The connector element according to claim 1, further comprising a plurality of connecting portions connecting said ground members to one another.

4. A connector comprising two connector elements according to claim 1, said connector elements being arranged adjacent to each other in a third direction perpendicular to said predetermined plane, said ground members in one of said connector elements being arranged in parallel to those in the other connector element.

5. The connector according to claim 4, comprising a back board interposed between said two connector elements and extending in parallel to said predetermined plane, said connector elements being fixed to said back board.

6. The connector according to claim 5, wherein the contacts in said one connector element and the contacts in said the other connector element are integrally coupled to each other through said back board.

7. The connector according to claim 1, wherein said specific contact has a widened portion, said ground plate contacting portion being formed at said widened portion.

8. The connector according to claim 1, further comprising a shield plate surrounding said insulator and said ground plate in cooperation with said housing, said ground plate having a shield plate contacting portion connected to said shield plate.

9. A connector apparatus comprising:

a package board side connector mounted on a package board; and a back board side connector mounted on a back board to be connected to said package board side connector, said back board side connector comprising:

a plurality of conductive back board side contacts arranged in a matrix;

a plurality of back board side ground plates; and an insulating housing holding said back board side contacts and said back board side ground plates, said back board side ground plates including first and second back board side ground plates, at least one of said first and said second back board side ground plates being provided with a contacting portion connected to the other, said first back board side ground plate being arranged obliquely across contact-to-contact spaces defined between every two adjacent ones of said back board side contacts adjacent in a column or a row direction from one contact-to-contact space to another contact-to-contact space next adjacent to the one contact-to-contact space both in the column direction and the row direction, said second back board side ground plate being arranged between two adjacent ones of said back board side contacts and in a direction intersecting said first back board side ground plate.

10. The connector apparatus according to claim 9, wherein a plurality of said back board side connectors are mounted on front and back surfaces of said back board so that said first and said second back board side ground plates on said front and said back surfaces are oriented in the same direction.

11. The connector apparatus according to claim 9, wherein said back board side contacts are used in common by said back board side connectors mounted on front and back surfaces of said back board.

12. The connector apparatus according to claim 9, wherein said package board side connector comprises:

a front housing fitted to said back board side connector;

a contact module including a plurality of package board side contacts and an insulator holding said package board side contacts;

a plurality of package board side ground plates; and a shield plate connected to said contact module and said package board, at least one of said package board side contacts having a ground plate contacting portion connected to said package board side ground plate, said insulator having a window portion where said ground plate contacting portion is exposed, a plurality of said contact modules being stacked, said package board side contact being brought into contact with said package board side ground plate through said window portion, said contact modules being integrally coupled by said shield plate and said front housing, said front housing being provided with a slot formed in an oblique direction inclined with respect to said column and said row directions so that said first back board side ground plate of said back board side connector is inserted.

13. The connector apparatus according to claim 12, wherein said package board side contact comprises:

a package board side contacting portion;

an intermediate portion; and a package board side connecting portion, said at least one package board side contact provided with said ground plate contacting portion having a widened portion formed at said intermediate portion and wider than the width of said intermediate portion in other package board side contacts without said ground plate contacting portion, said ground plate contacting portion being formed at said widened portion in the intermediate portion.

14. The connector apparatus according to claim 12, wherein said package board side ground plate is provided with a shield contacting portion connected to said shield plate.

* * * * *